US006278849B1

(12) United States Patent
Kawasaki

(10) Patent No.: US 6,278,849 B1
(45) Date of Patent: Aug. 21, 2001

(54) DEVELOPING APPARATUS FOR DEVELOPING AN ELECTROSTATIC LATENT IMAGE ON AN IMAGE CARRYING MEMBER

(75) Inventor: Akihiro Kawasaki, Itami (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/399,361

(22) Filed: Sep. 20, 1999

(30) Foreign Application Priority Data

Sep. 21, 1998 (JP) ..... 10-266541

(51) Int. Cl.[7] ..... G03G 15/06; G03G 15/08
(52) U.S. Cl. ..... 399/55; 399/284; 399/285
(58) Field of Search ..... 399/55, 270, 274, 399/284, 285

(56) References Cited

U.S. PATENT DOCUMENTS

| | | | | |
|---|---|---|---|---|
| 5,309,206 | | 5/1994 | Deishi et al. . | |
| 5,519,472 | | 5/1996 | Ojima et al. . | |
| 5,568,236 | | 10/1996 | Toda et al. . | |
| 5,570,166 | * | 10/1996 | Ohzeki et al. | 399/270 |
| 5,600,419 | | 2/1997 | Sakuraba et al. | 399/285 |
| 5,682,585 | * | 10/1997 | Yamaguchi et al. | 399/274 |
| 5,761,590 | * | 6/1998 | Sato | 399/285 |
| 6,006,060 | * | 12/1999 | Sato | 399/284 |

FOREIGN PATENT DOCUMENTS 5-19145 3/1993 (JP) .

* cited by examiner

*Primary Examiner*—William J. Royer
(74) *Attorney, Agent, or Firm*—Burns, Doane, Swecker & Mathis, LLP

(57) ABSTRACT

A conductive contact member 5 is disposed to come into contact with a developer carrying member 4 at the upstream side of a developing region 9 with respect to the developer conveying direction. Voltage applying members 11, 12 and 13 are also provided for applying the developer carrying member 4 with a predetermined direct voltage as a developing voltage, applying the contact member 5 with a direct voltage which has the same polarity as the developing voltage and has an absolute value larger than the developing voltage, and applying between the developer carrying member 4 and the contact member 5 an alternating voltage. A ratio $t_1/t_2$ of a time $t_1$ for applying a voltage of absolute value larger than that of a center voltage of the alternating voltage to a time $t_2$ for applying a voltage of absolute value smaller than that of the center voltage of the alternating voltage satisfies a relation of $t_1/t_2>1$.

21 Claims, 10 Drawing Sheets

DEVELOPING APPARATUS FOR DEVELOPING AN ELECTROSTATIC LATENT IMAGE ON AN IMAGE CARRYING MEMBER

This application is based on application No. H10-266541 filed in Japan on Sep. 21, 1998, the content of which is hereby incorporated by reference.

BACKGROUND OF THE INVENTION

The present invention relates to a developing apparatus for use in a copying machine, a printer and so on.

In a conventional developing apparatus, developer is carried on a developing sleeve applied with a predetermined developing bias voltage and conveyed to a developing region, where the developer serves to develop an electrostatic latent image formed on an electrostatic latent image carrier. In order to triboelectrically charge the toner and to regulate a quantity of the toner, a developer regulating member is provided to come into contact with the developing sleeve.

In the case that non-magnetic toner is used as the developer, there has been a disadvantage that the toner is difficult to enter between the developing sleeve and the toner regulating member because of its poor fluidity, whereby a uniform toner layer can not be formed on the developing roller.

In order to eliminate the above disadvantage, Japanese patent publication 5-19145 proposes a developing apparatus in which an alternating voltage is applied to the developer regulating member to form an alternating electric field between the developing sleeve and the toner regulating member. In this developing apparatus, the alternating electric field causes micro-oscillation of the toner regulating member, allowing the non-magnetic toner of poor fluidity to smoothly enter between the developing sleeve and the toner regulating member, whereby a uniform toner layer can be formed on the developing roller.

Further, the conventional developing apparatus does not have sufficient compliance with a high density and high area-rate of image. Therefore, a toner consuming portion of an image print pattern is printed with a smaller quantity of toner than a toner non-consuming portion due to insufficient compliance when the toner consuming portion reaches a developing region, causing a ghost (negative-memory). If there is a solid image or the like before a half-tone image, the toner quantity is reduced, whereby dots can not be reproduced, resulting in an unclear image and bad tone reproduction.

To this end, in the conventional developing apparatus in which an alternating voltage is applied to the developer regulating member, it will be considered that not only the toner is sufficiently oscillated to be triboelectrically charged by enlarging the peak voltage of the alternating voltage or by making the frequency of the alternating voltage high, but also the toner is made movable to the developer carrying member by enlarging the potential difference between the direct current component of the developing bias applied to the developer carrying member and the direct current component of the blade bias applied to the toner regulating blade. However, both the developer carrying member and the developer regulating blade are made of conductive material and opposed to each other, which causes a leak at a potential difference of about 500V in accordance with the Pachen's law, resulting in image noise.

In order to reduce the maximum potential difference including the alternating component between the developing bias and the blade bias below 500v, the peak voltage difference is enlarged to activate the toner oscillation, the direct voltage difference would be made small. On the contrary, if movement of the toner to the developer carrying member is emphasized, the peak voltage difference would be made small. This means that the conventional developing apparatus is not enough to reduce the maximum potential difference between the developing bias and the blade bias below 500v. For example, even if the potential difference is reduced to 500V by using only a direct current component, the toner would not be oscillated and triboelectrically charged, resulting in no effect. Even if the potential difference of the direct component is reduced to 250V an alternating component having an amplitude of 500v is applied, enough effect would not be obtained.

In addition, a variation in toner fluidity due to deterioration of the toner caused by long-term printing or a variation in environment causes a variation in conveying quantity and charge property of the toner, which causes a problem that stability of tone reproduction could not be maintained until the end of apparatus life.

SUMMARY OF THE INVENTION

Accordingly, it is an object of the present invention to provide a developing apparatus that prevents deterioration of image quality due to leakage, holding cost-up and oscillation sound to a minimum, decreasing the difference of developing property on the developer carrying member between developer consuming time and developer non-consuming time, enhancing compliance with a high density of image and a high printing area rate of image, decreasing ghost of image, attempting stabilization of tone reproduction and uniformalization of halftone, and realizing high image quality.

In order to solve the aforementioned problems, the present invention provides a developing apparatus for developing an electrostatic latent image formed on an image carrying member with developer, the developing device comprising:

a developer carrying member for carrying developer and conveying it to a developing region;

a conductive contact member positioned to come into contact with the developer carrying member at the upstream side of the developing region with respect to the developer conveying direction; and a voltage applying member for applying the developer carrying member with a predetermined direct voltage as a developing voltage, applying the contact member with a direct voltage which has the same polarity as the developing voltage and an absolute value larger than the developing voltage, and applying between the developer carrying member and the contact member with an alternating voltage;

wherein a ratio $t_1/t_2$ of a time $t_1$ for applying a voltage of absolute value larger than that of a center voltage of the alternating voltage to a time $t_2$ for applying a voltage of absolute value smaller than that of the center voltage of the alternating voltage satisfies a relation of $t_1/t_2>1$.

The contact member may be a developer regulating member for regulating a quantity of developer on the developer carrying member. Instead of making the developer regulating member the contact member, the contact member may be positioned at the upstream side of the developer regulating member with respect to the developer conveying direction.

According to the present invention having the above construction, the voltage applying time at the high voltage side of the alternating voltage applied between the developer carrying member and the contact member is longer than that at low voltage side, whereby the developer fully moves from the developer regulating member to the developer carrying member. Thus, the conveyance of the developer to the developer carrying member at the toner consuming time is enhanced, enabling stabilized developing properties whether the developer is consumed or not. As a result, it is possible to enhance compliance with a high density of image and a high printing area rate of image, decrease ghost of image, attempt stabilization of tone reproduction and uniformalization of halftone, and realize high image quality.

Preferably, the developing apparatus of the present invention may further comprise a controller for controlling the direct voltage applied to the contact member to regulate an image density. Thus, in spite of long-term printing or variation in environment, the developing property can be stabilized by controlling the direct voltage applied to the contact member.

Alternatively, the developing apparatus of the present invention may further comprise a controller for controlling the ratio $t_1/t_2$ of the alternating voltage to regulate an image density. Thus, in spite of long-term printing or variation in environment, the developing property can be also stabilized by controlling the ratio $t_1/t_2$ of the alternating voltage.

The voltage applying member can apply either the contact member or the developer carrying member with the alternating voltage.

The alternating voltage may have any wave form including a square wave form. In the case of a square wave form, the aforementioned ratio $t_1/t_2$ is a ratio of a time $t_1$ for applying a voltage $V_1$ of maximum absolute value to a time $t_2$ for applying a voltage $V_2$ of minimum absolute value.

Preferably, the developing apparatus of the present invention may further comprise a controller for controlling the difference $V_1-V_2$ between the voltage $V_1$ and the voltage $V_2$ within a range of 300–1000V to regulate an image density. Thus, in spite of long-term printing or variation in environmental, the developing property can be stabilized by controlling the difference $V_1-V_2$ of the alternating voltage.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

<First Embodiment>

Figure 1:
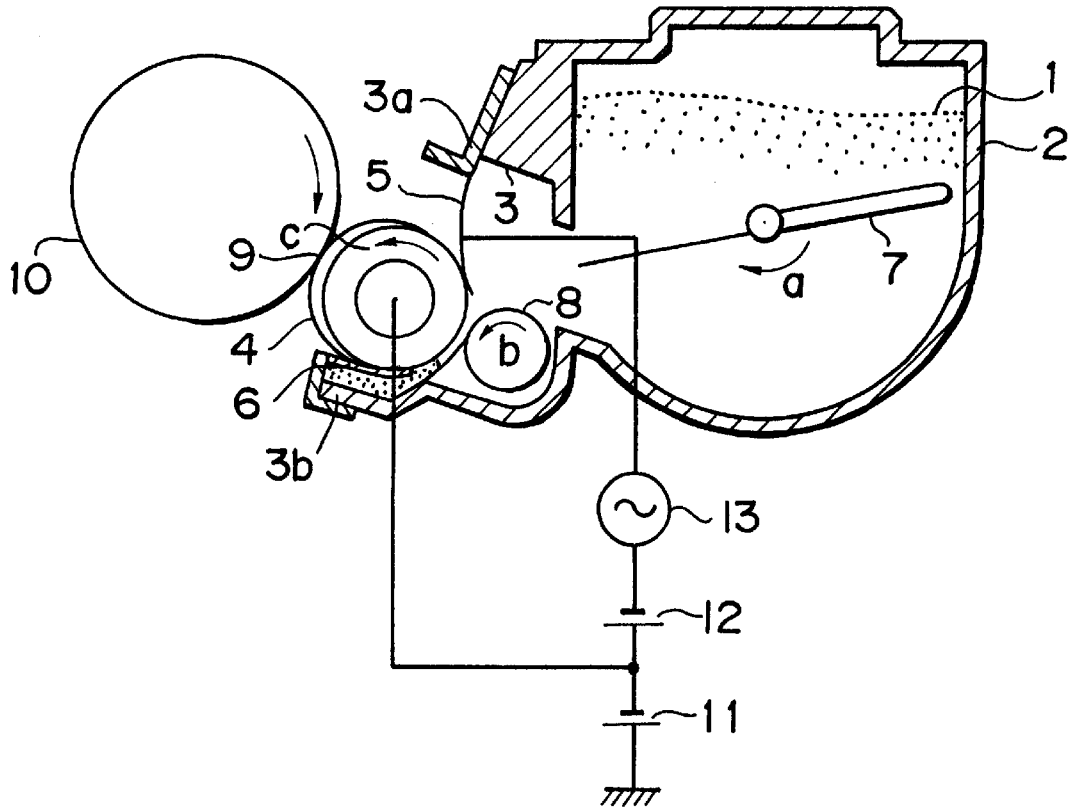
FIG. 1 is a sectional view of a developing apparatus according to a first embodiment of the present invention.

FIG. 1 shows a developing apparatus according to a first embodiment of the present invention. The developing apparatus comprises a hopper 2 containing developer toner 1. The hopper 2 is formed with an opening 3. In the opening 3 of the hopper 2, a developing sleeve 4 is rotatably disposed in a direction of arrow "c". Between an opening edge 3*a* of the opening 3 of the hopper 2 and the developing sleeve 4 is disposed a developer regulating member 5, while between an another opening edge 3*b* of the opening 3 of the hopper 2 and the developing sleeve 4 is disposed a seal member 6. Inside the hopper 2, there are disposed an agitating member 7 for agitating the developer 1 and a feed roller 8 for feeding the developer 1 to the developing sleeve 4. The developing sleeve 4 is arranged to come into contact with a photoreceptor 10 at a developing region 9.

Figure 2:
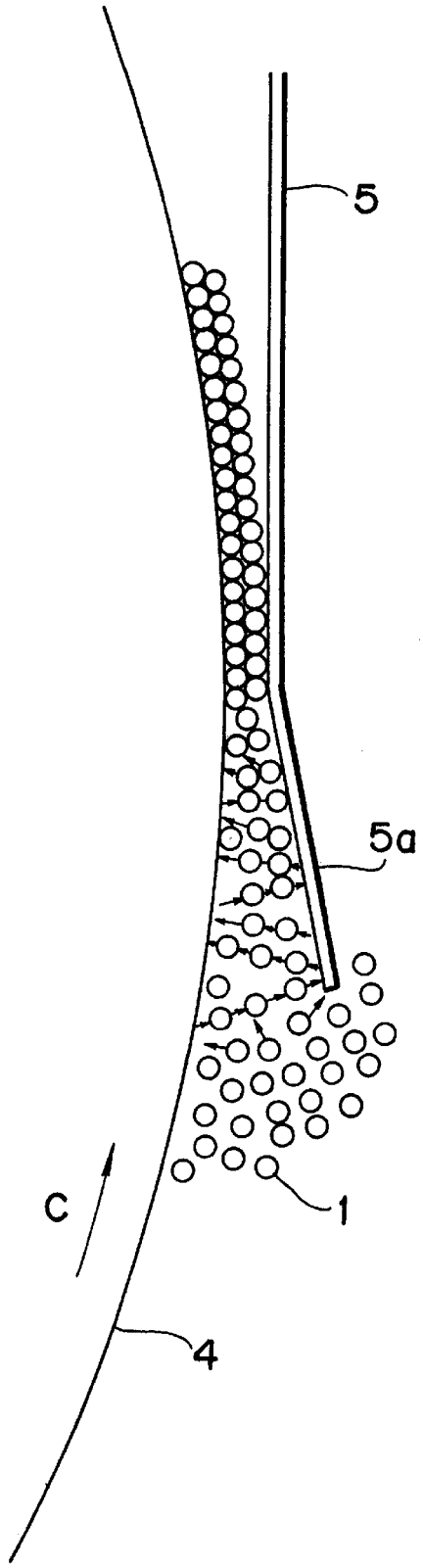
FIG. 2 is an enlarged view showing a state of toner between the developer regulating member and the developing member.

As the developer 1, a non-magnetic single-component developer or toner which can be charged to negative polarity is used. The developer regulating member 5 is made of metal such as stainless steel having a thickness of 0.1 mm. As shown in FIG. 2, the developer regulating member 5 is bent at an angle of 9° at a point apart by 4 mm from a free end thereof so as to receive the toner 1 so that the bent portion is positioned at a contact nip portion to the developing sleeve 4. The seal member 6 comprises a conductive sheet in order to prevent the toner 1 from adhering to the seal member 6. The developing sleeve 4 is made of nylon or the like having a resistance of $10^6$–$10^8$ Ω/□ and a roughness of about Rz=5 μm.

The developing sleeve 4 is connected to earth via a direct current source 11 so that the developing sleeve is applied with a predetermined voltage. The developer regulating member 5 is connected to earth via an alternating current source 13, a direct current source 12 and the direct current source 11. Thus, the developer regulating member 5 is applied with a voltage obtained by superimposing an alternating voltage component on a direct voltage component having same polarity as that applied to the developing sleeve 4 and having a larger absolute value than that applied to the developing sleeve 4.

Figure 3:
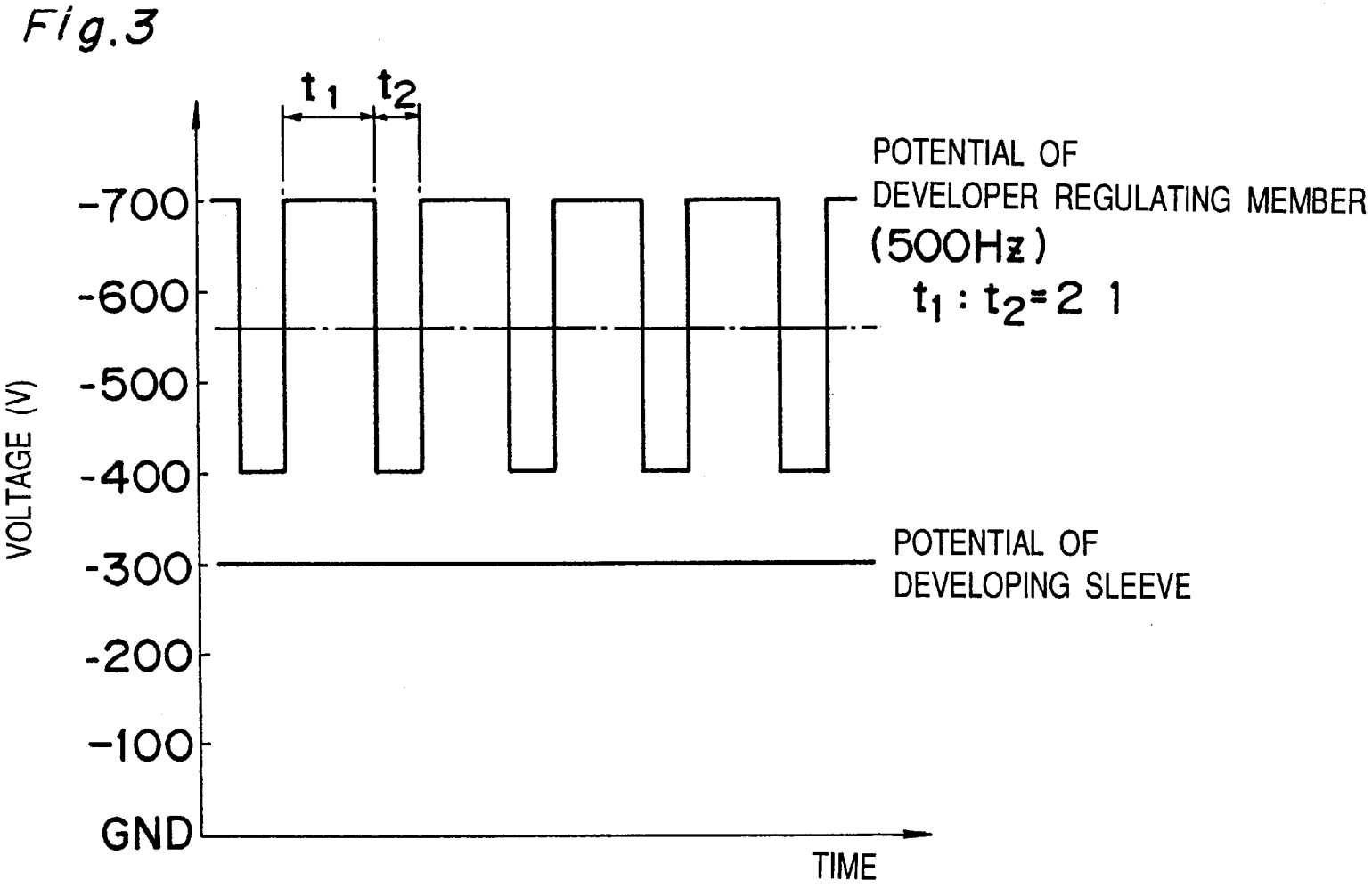
FIG. 3 is a graph showing a change of voltage applied to a developing sleeve and a developer regulating member.

For example, as shown in FIG. 3, the developing sleeve 4 is applied with a voltage of −300V, while the developer regulating member S is applied with an alternating voltage that alternates a voltage having a maximum absolute valve, i.e. a voltage $V_1$ of −700V with a voltage having a minimum absolute valve, i.e. a voltage $V_2$ of −400V at a frequency of 500 Hz. A ratio $t_1/t_2$ of a time $t_1$ for applying the maximum voltage $V_1$ to a time $t_2$ for applying the minimum voltage $V_2$ is set to 2. Although the waveform of the voltage as shown in FIG. 3 is at a non-load time, it presents a little different waveform at a load time due to an impedance of the developing sleeve 4 and so on.

Operation of the developing apparatus having the above construction will be described hereinafter.

The toner 1 in the hopper 2 is agitated by the agitating member 7 rotating in a direction of "a" and fed to the developing sleeve 4 by the feed roller 8 rotating in a direction of arrow "b". In the vicinity of the developer regulating member 5, as shown in FIG. 2, the toner 1 that exists in a wedge-shaped space defined by an end portion 5*a* of the developer regulating member S and the developing sleeve 4 is oscillated by the alternating voltage applied to the developer regulating member 5 and triboelectrically charged. Then, the toner 1 is captured on the developing sleeve 4 by the rotation of the developing sleeve 4 in the direction of arrow "c". The toner capturing property of the apparatus according to the present invention is more enhanced than the prior art because the oscillation of the toner 1 increases the chance of contacting and charging of the toner 1 so that the toner 1 is uniformly charged. As described above, since the ratio $t_1/t_2$ of the voltage applying time is set to more than 1 so that the voltage applying time on the maximum voltage side is longer than the minimum voltage side, a time period that the charged toner 1 is attracted to the developing sleeve side becomes longer, whereby the toner 1 can be easily captured on the developing sleeve 4 from the wedge-like space.

When the toner 1 captured on the developing sleeve 4 passes through the developer regulating member 5, the toner 1 is triboelectrically charged and a conveying quantity thereof is regulated. The toner 1 on the developing sleeve 4 is further conveyed in the direction of arrow "c" to the developing region 9 opposing to the photoreceptor 10, where the toner 1 is spent on developing of an electrostatic latent image on the photoreceptor 10. The toner 1 that has passed through the developing region 9 is conveyed in the direction of arrow "c" to pass through the seal member 6 and return to the hopper 2, repeating the same operation.

Figure 4:
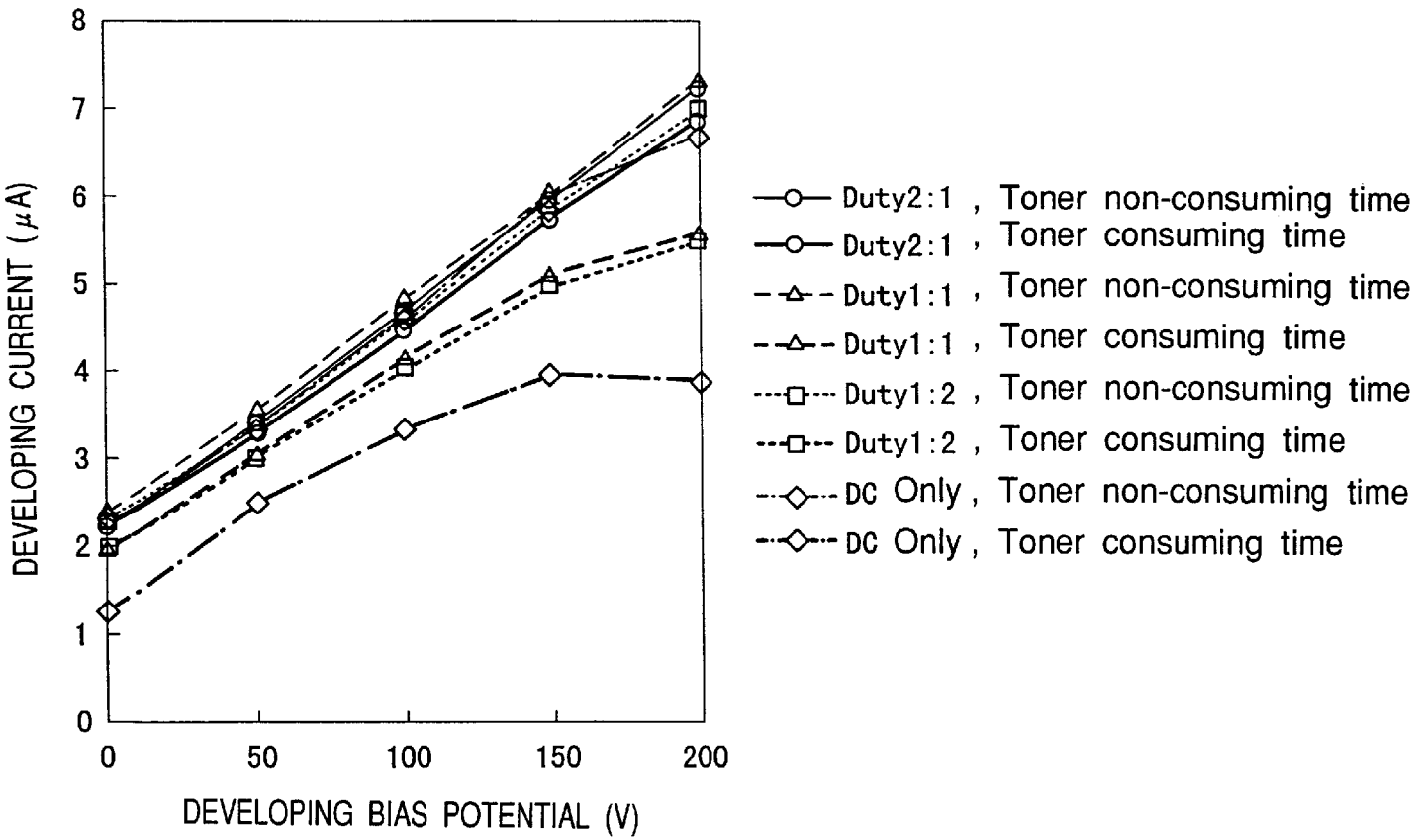
FIG. 4 is a graph showing a change of developing current to developing bias potential.

The present inventor has made an experiment to verify the effect of the present invention. The developing bias voltage of the direct current source 11 was changed, holding the voltage to the developing sleeve 4 and the developer regulating member 5, to vary the toner developing quantity from the developing sleeve 4 to the photoreceptor 10. While doing this, the developing current from the photoreceptor 10 to the developing sleeve 4 was measured to obtain a developing property, i.e. a relation of developing current to developing bias potential. This experiment was made, considering an error factor, in the cases that the voltage applying time ratio (duty) $t_1:t_2$ is 2:1, 1:1 and 1:2, and the case that only the direct voltage as in the prior art is applied to the developer regulating member 5 without superimposing the alternating voltage on the direct voltage. As the error factor, a toner non-consuming time (at a printing time of white document) and a toner consuming time (at a printing time of black image document) were considered. As a result, as shown in FIG. 4, it was verified that the developing property in the case of applying the alternating voltage was not changed between the toner non-consuming time and the toner consuming time in comparison with that in the case of applying only the current voltage. It is also verified that the developing property in the case that the voltage applying time ratio $t_1:t_2$ is 1:1 was changed to the same degree between the toner non-consuming time and the toner consuming time in comparison with that in the case that the voltage applying time ratio $t_1:t_2$ is 1:2. However, the developing property in the case that the voltage applying time ratio $t_1:t_2$ is 2:1 was little changed between the toner non-consuming time and the toner consuming time. Thus, it was verified that the developing property can be stabilized by enlarging the voltage applying time at the maximum voltage side with respective to the voltage applying time at the minimum voltage side.

Figure 5:
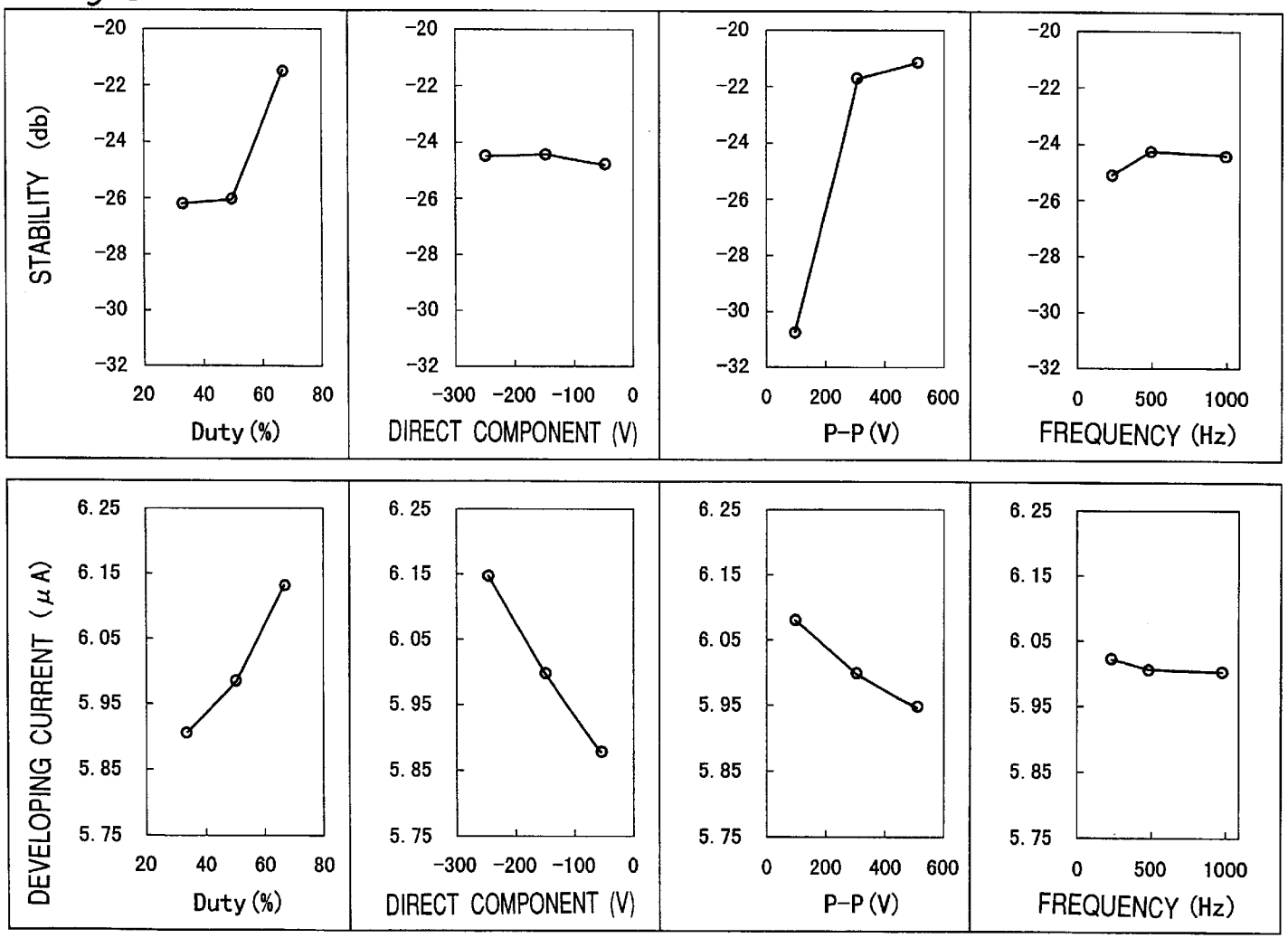
FIG. 5 is a graph showing changes of developing current and stability thereof to duty, direct current component, amplitude of alternating voltage and frequency.

The upper four graphs in FIG. 5 show stability of developing property when changing the error factor, i.e., when changing from a toner non-consuming time to a toner consuming time in three conditions of voltage applying time ratio (duty; %), in three conditions of voltage of direct current component of alternating voltage (V), in three conditions of amplitude of alternating voltage (P—P), and in three conditions of frequency of alternating voltage (Hz). The stability of developing property is presented by a decibel value (so-called, S/N ratio). The lower four graphs in FIG. 5 show developing current at toner consuming time in a predetermined voltage. Ideally, the developing current I to the developing bias potential V in FIG. 4 is expressed by a linear line, i.e. $I=\alpha+\beta V$. When a dispersion of the developing current I from the linear line is $\sigma$, S/N ratio is defined by following equation.

$$S/N=10\log(\beta^2/\alpha^2)\ \text{(db)}$$

Although the amplitude of the alternating voltage in the alternating current source 13 is set to 300V, this voltage is enough in practical use. It was found that even if the amplitude of the alternating voltage is enlarged up to 500V, the change of developing property would not appear as described hereinafter, but oscillation sound due to oscillation of the developer regulating member 5 would become larger. If the oscillation of the alternating voltage is 300V or so, a level of oscillation sound is no problem. If the oscillation of the alternating voltage is 300V and the frequency thereof is 500 Hz, the maximum voltage and the minimum voltage can be set by switching of a timer, whereby a developing apparatus having a high stability of developing property would be provided without causing much of an increase in cost.

<Second Embodiment>

Figure 6:
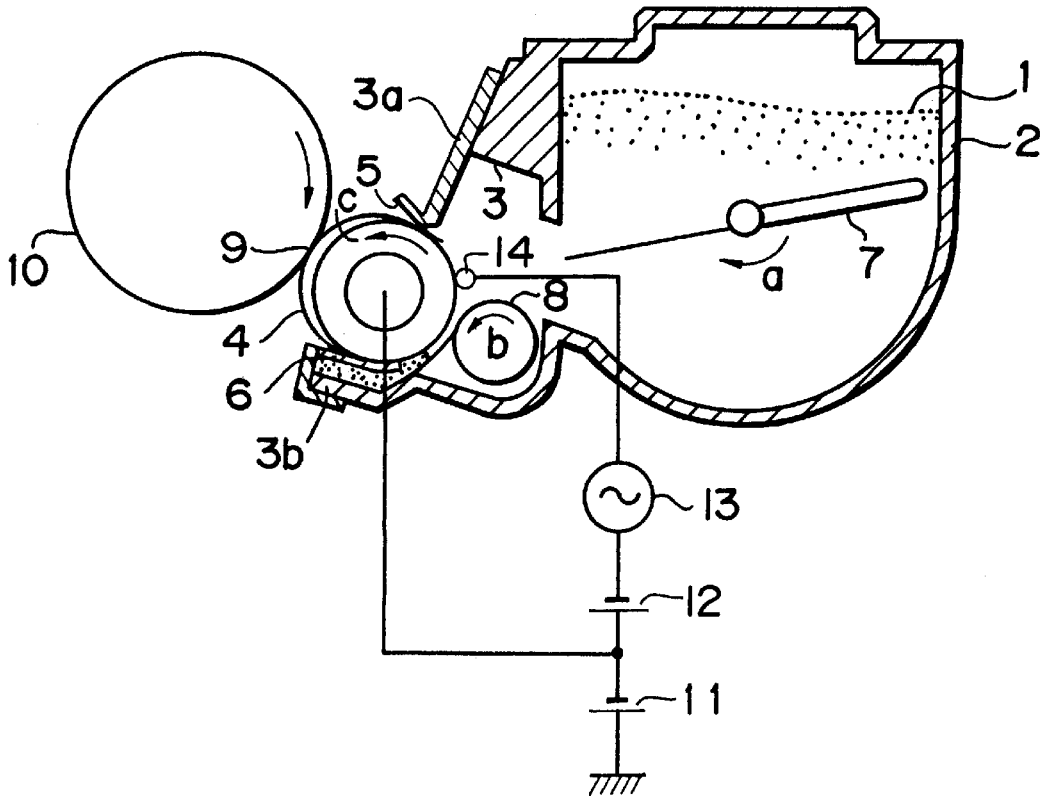
FIG. 6 is a sectional view of a developing apparatus according to a second embodiment of the present invention.

FIG. 6 shows a developing apparatus according to a second embodiment of the present invention. The developing apparatus is substantially the same as that of the first embodiment except that the developer regulating member 5 is made of silicon rubber considering charge and adhesion of the toner, that a conductive contact member 14 is disposed on the upstream side of the developer regulating member 5, and that the contact member 14 is connected to earth via the alternating current source 13 and the direct current sources 11, 12. The same reference numbers are attached to the parts corresponding to that in the aforementioned first embodiment.

Figure 7:
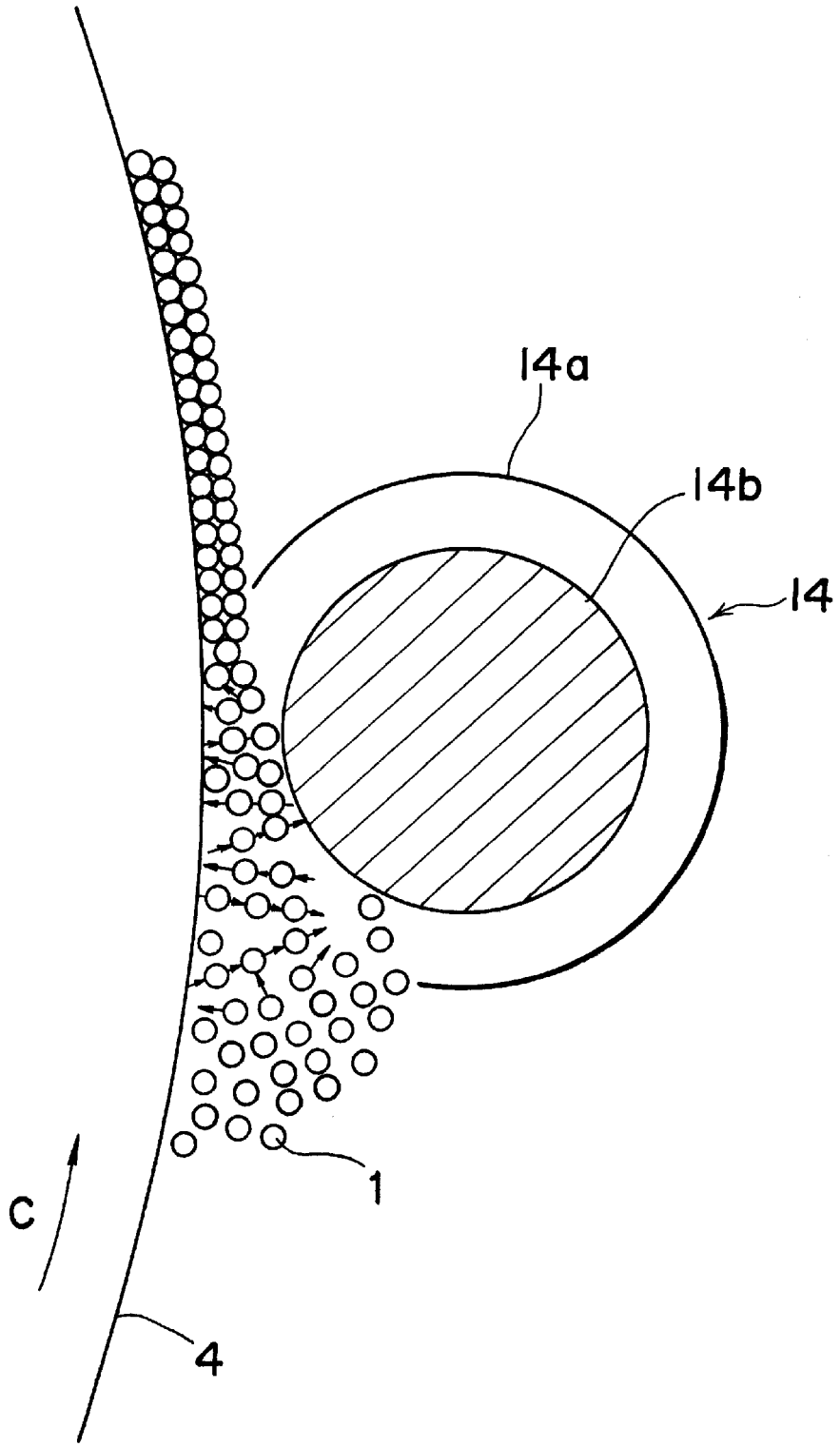
FIG. 7 is an enlarged view showing a state of toner between a developing sleeve and a rod.

The conductive contact member 14 comprises a bar made of stainless steel having a circular cross section and extends along the axis of the developing sleeve 4. The contact member 14 includes large diameter portions 14*a* at both ends thereof. The large diameter portions 14*a* were supported so as to come into contact with the developing sleeve 4 outside of the image area. Intermediate portion 14*b* of the contact member 14 is adjacent to the image area of the developing sleeve 4 as shown in FIG. 7.

The toner 1 existing between the contact member 14 and the developing sleeve 4 is oscillated by the alternating voltage applied to the contact member 14 and triboelectrically charged. Then, the toner 1 is captured on the developing sleeve 4 by the rotation of the developing sleeve 4 in the direction of arrow "c". The toner capturing property of the apparatus according to the present invention is more enhanced than the prior art because the oscillation of the toner 1 increases the chance of contacting and charging of the toner 1 so that the toner 1 is uniformly charged. Since the ratio $t_1/t_2$ of voltage applying time is set to more than 1 so that the voltage applying time on the maximum voltage side is longer than the minimum voltage side, a time period that the charged toner 1 is attracted to the developing sleeve side becomes longer, whereby the toner 1 can be easily captured on the developing sleeve 4 from the space between the contact member 14 and the developing sleeve 4.

In the second embodiment, because of adding the contact member 14, the number of members increases as compared to the first embodiment. However, the contact member 14 allows the toner layer on the developing sleeve 4 to be more uniformly charged and conveyed than the first embodiment.

In the second embodiment, the developer regulating member 5 may be made of conductive material and is applied with a direct voltage or a voltage obtained by superimposing an alternating voltage on the direct voltage in the same manner as the first embodiment <Third Embodiment>

Figure 8:
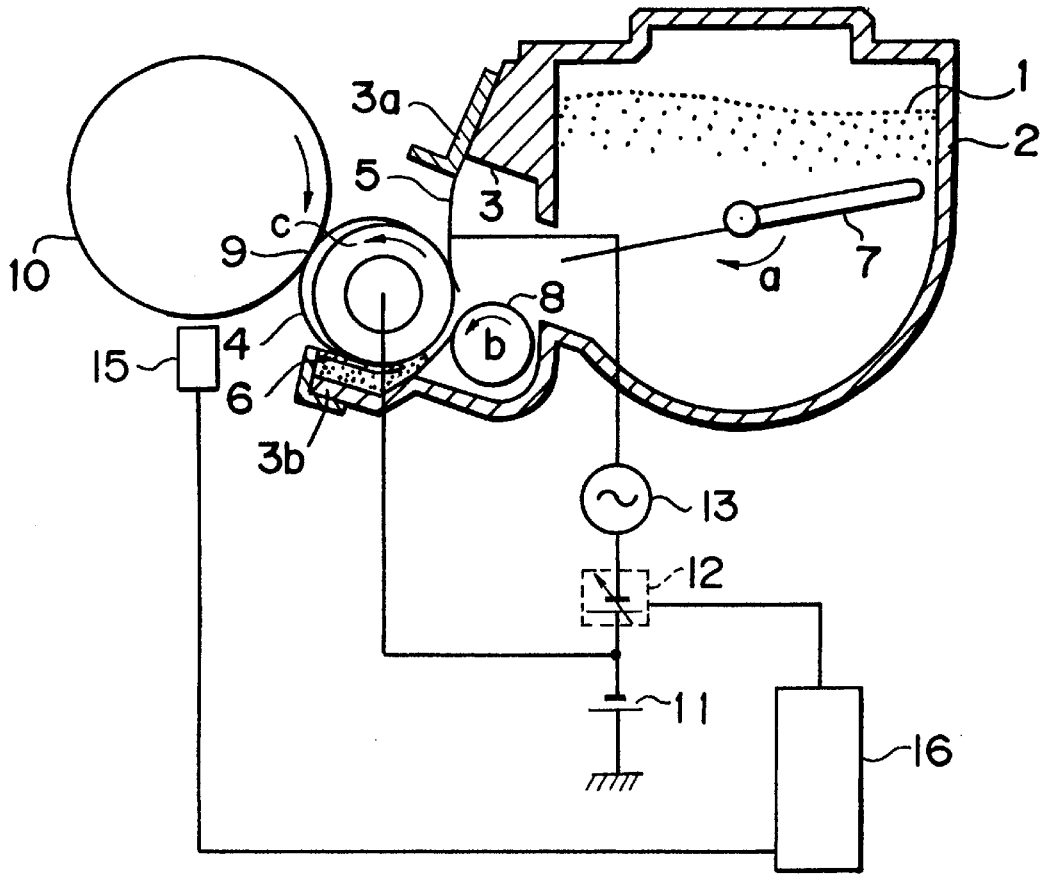
FIG. 8 is a sectional view of a developing apparatus according to a fourth embodiment of the present invention.

FIG. 8 shows a developing apparatus according to a third embodiment of the present invention. The developing apparatus is substantially the same as that of the first embodiment except that the direct current source 12 is a voltage-variable type, that an image density sensor 15 is disposed at the downstream side of the developing region 9, and that the voltage of the direct current source 12 is controlled by a control unit 16 in response to an image density detected by the image density sensor 15. The same reference numbers are attached to the parts corresponding to that in the aforementioned first embodiment.

The image density sensor 15 detects a density of an image-density detecting pattern formed on the photoreceptor 10. The control unit 16 changes the voltage of the direct current source 12 in response to the image density detected by the image density sensor 15. According to this control, a change of sensitivity due to long-term printing of the photoreceptor 10 or variation in environmental, or a slight change of density due to variation of charge property of the toner 1 can be adjusted, whereby a high quality image can be obtained.

As show in FIG. 5, if the voltage applying time ratio is set to 66.7% (2:1), the developing property will not be dispersed with respect to the error factor. In this condition, even if the direct current component of the direct current source 12 is changed, the stability of the developing property will not vary. The change of direct current component of the direct current source 12 causes the developing current to linearly vary, resulting in variation in gradient of the developing property. Utilizing this characteristic, for example, if the density is desired to be higher, the potential difference between the developing sleeve 4 and the developer regulating member 5 is made larger. Thus, stabilization of the density is ensured by a feed-back control.

<Fourth Embodiment>

Figure 9:
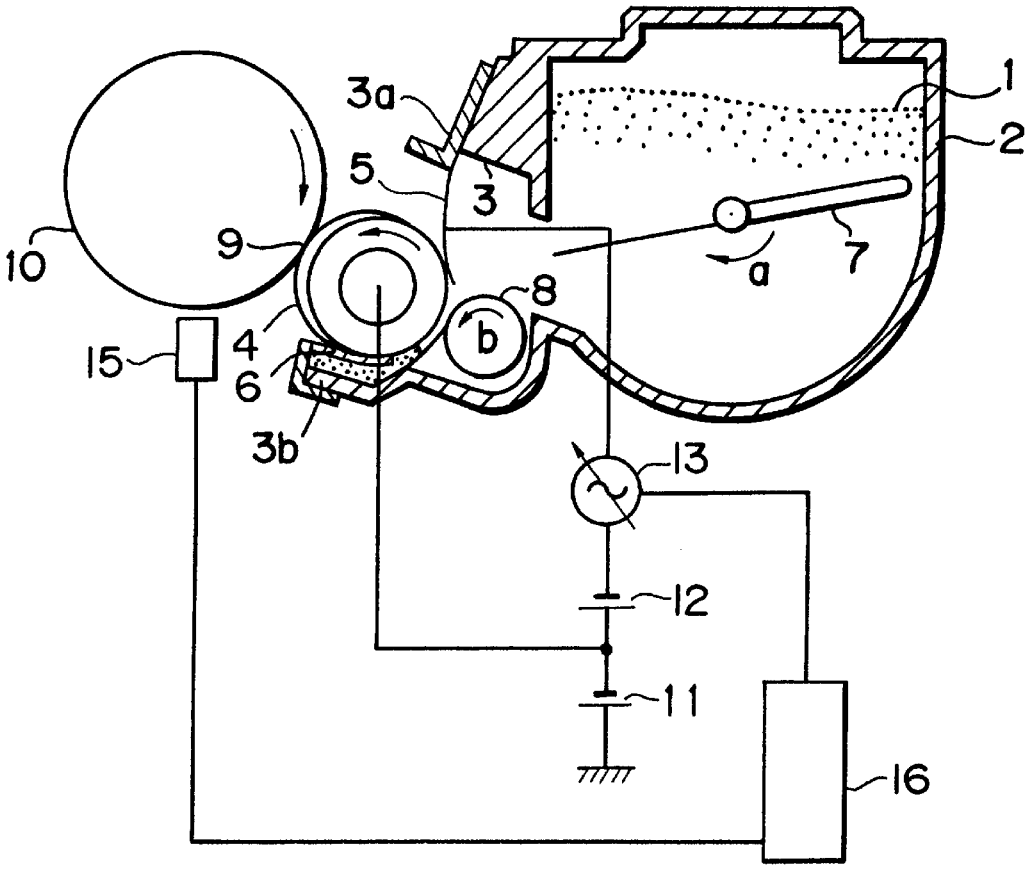
FIG. 9 is a sectional view of a developing apparatus according to a -fifth embodiment of the present invention.

FIG. 9 shows a developing apparatus according to a fourth embodiment of the present invention. The developing apparatus is substantially the same as that of the first embodiment except that an image density sensor 15 is disposed at the downstream side of the developing region 9, and that the voltage applying time ratio of the alternating current source 13 is controlled by a control unit 16 in response to an image density detected by the image density sensor 15. The same reference numbers are attached to the parts corresponding to that in the aforementioned first embodiment.

The image density sensor 15 detects a density of an image-density detecting pattern formed on the photoreceptor 10. The control unit 16 changes the voltage applying time ratio of the alternating current source 13 in response to the image density detected by the image density sensor 15. According to this control, a change of sensitivity of the photoreceptor 10 due to long-term printing or variation in environment, or a slight change of density due to variation of charge property of the toner 1 can be adjusted, whereby a high quality image can be obtained.

As shown in FIG. 5, the change of voltage applying time ratio (duty) of the alternating current source 13 causes the developing current to linearly vary, resulting in variation in gradient of the developing property. Utilizing this characteristic, for example, if the density is desired to be higher, the voltage applying time ratio (duty) is made larger. Thus, stabilization of the density is ensured by a feed-back control. In order to suppress the dispersion of the developing property with respect to the error factor, it is preferable to control the voltage applying time ratio (duty) within the range of more than 1 in the same manner as in the first embodiment.

<Fifth Embodiment>

In a developing apparatus (not shown) according to a fifth embodiment of the present invention, instead of the voltage applying time ratio as in the fourth embodiment, the amplitude of an alternating current source is controlled by a control unit in response to an image density detected by the image density sensor. According to this control, a change of sensitivity of a photoreceptor due to long-term printing or variation in environment, or a slight change of density due to variation of charge property of the toner can be adjusted, whereby a high quality of image can be obtained.

As show in FIG. 5, if the amplitude of the alternating voltage (P—P) of the alternating current source is set to more than 300V, the developing property will not be dispersed with respect to the error factor. In this condition, even if the amplitude of the alternating voltage (P—P) is changed, the stability of the developing property will not vary. The change of amplitude of the alternating voltage (P—P) of the alternating current source causes the developing current to linearly vary, resulting in variation in gradient of the developing property. When the amplitude of the alternating voltage (P—P) is in the extent of 1000V, voltage leak is caused frequently. Therefore, allowable range for changing the amplitude of the alternating voltage (P—P) should be 300–1000V. Utilizing this characteristic, for example, if the density is desired to be higher, the amplitude of the alternating voltage (P—P) of the alternating current source is made larger. Thus, stabilization of the density is ensured by a feed-back control. In order to suppress the dispersion of the developing property with respect to the error factor, it is preferable to control the voltage applying time ratio (duty) within the range of more than 1 in the same manner as in the first embodiment.

<Sixth Embodiment>

Figure 10:
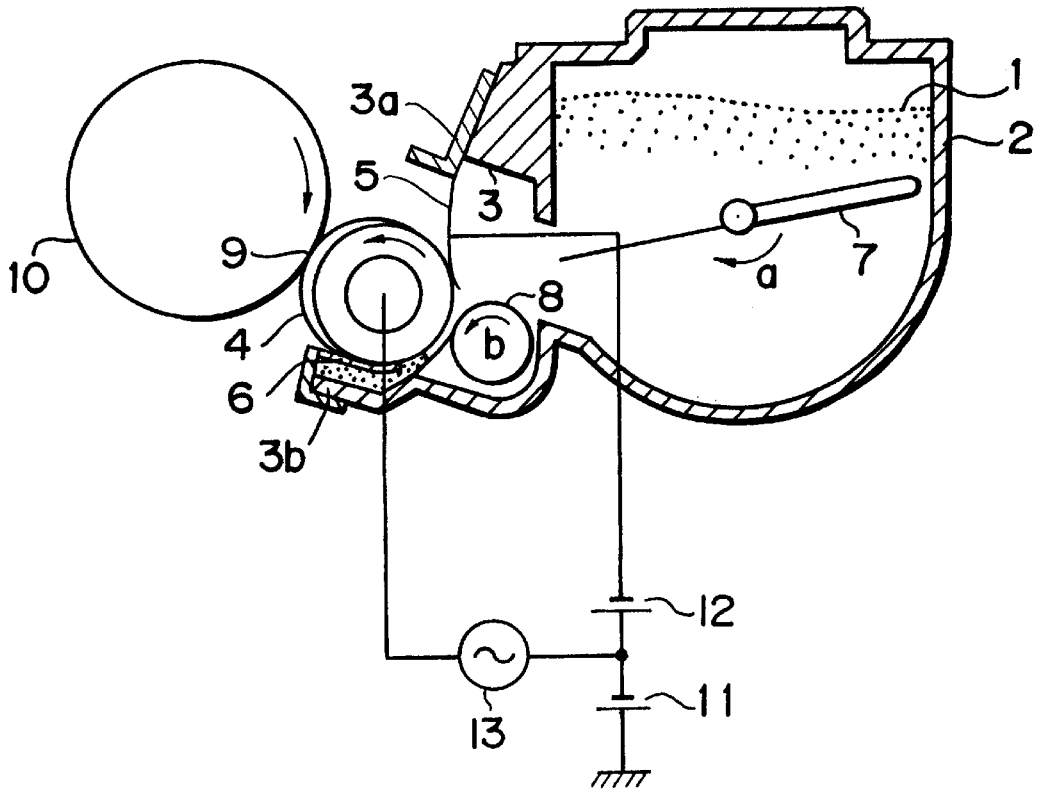
FIG. 10 is a sectional view of a developing apparatus according to a sixth embodiment of the present invention.

FIG. 10 shows a developing apparatus according to a sixth embodiment of the present invention. The developing apparatus is substantially the same as that of the first embodiment except that the developing sleeve 4 is connected to earth via the alternating current source 13 and the direct current source 11, and that the developing sleeve 4 is applied with a voltage obtained by superimposing an alternating voltage of the alternating current source 13 on a direct voltage component of the direct current source 11. The same reference numbers are attached to the parts corresponding to that in the aforementioned first embodiment.

In the developing apparatus of the sixth embodiment, an oscillating electric field is formed between the developing sleeve 4 and the developer regulating member 5, causing the same effects as in the previous embodiments. Furthermore, by setting the frequency and the amplitude of the alternating current voltage, a high quality image can be obtained.

In the aforementioned embodiments, although the non-magnetic single-component developer or toner which can be charged to negative polarity is used as the developer, magnetic toner or toner which can be charged to positive polarity can also be used.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A developing apparatus for developing an electrostatic latent image formed on an image carrying member with developer, the developing apparatus comprising:

a developer carrying member for carrying developer and conveying it to a developing region;

a conductive contact member positioned to come into contact with the developer carrying member at an upstream side of the developing region with respect to the developer conveying direction; and a voltage applying member for applying the developer carrying member with a predetermined direct voltage as a developing voltage, applying the contact member with a direct voltage which has the same polarity as the developing voltage and has an absolute value larger than the developing voltage, and applying between the developer carrying member and the contact member an alternating voltage;

wherein a ratio $t_1/t_2$ of a time $t_1$ for applying a voltage of absolute value larger than that of a center voltage of the alternating voltage to a time $t_2$ for applying a voltage of absolute value smaller than that of the center voltage of the alternating voltage satisfies a relation of $t_1/t_2>1$.

2. The developing apparatus as in claim 1, wherein the contact member is a developer regulating member for regulating quantity of developer on the developer carrying member.

3. The developing apparatus as in claim 1 further comprising a developer regulating member for regulating quantity of developer on the developer carrying member, wherein the contact member is positioned at the upstream side of the developer regulating member with respect to the developer conveying direction.

4. The developing apparatus as in claim 1 further comprising a controller for controlling the direct voltage applied to the contact member to regulate an image density.

5. The developing apparatus as in claim 4 further comprising a density sensor for detecting an image density of a pattern image formed on the image carrying member, wherein the controller controls the direct voltage in response to a detected value of the density sensor.

6. The developing apparatus as in claim 1 further comprising a controller for controlling the ratio $t_1/t_2$ of the alternating voltage to regulate an image density.

7. The developing apparatus as in claim 6 further comprising a density sensor for detecting an image density of a pattern image formed on the image carrying member, wherein the controller controls the ratio $t_1/t_2$ of the alternating voltage in response to a detected value of the density sensor.

8. The developing apparatus as in claim 1, wherein the voltage applying member applies the contact member with the alternating voltage.

9. The developing apparatus as in claim 1, wherein the voltage applying member applies the developer carrying member with the alternating voltage.

10. A developing apparatus for developing an electrostatic latent image formed on an image carrying member with developer, the developing apparatus comprising:

a developer carrying member for carrying developer and conveying it to a developing region;

a conductive contact member positioned to come into contact with the developer carrying member at an upstream side of the developing region with respect to the developer conveying direction; and a voltage applying member for applying the developer carrying member with a predetermined direct voltage as a developing voltage, applying the contact member with a direct voltage which has the same polarity as the developing voltage and has an absolute value larger than the developing voltage, and applying between the developer carrying member and the contact member an alternating voltage;

wherein a ratio $t_1/t_2$ of a time $t_1$ for applying a voltage $V_1$ of maximum absolute value to a time $t_2$ for applying a voltage $V_2$ of minimum absolute value satisfies a relation of $t_1/t_2>1$.

11. The developing apparatus as in claim 10, wherein the contact member is a developer regulating member for regulating quantity of developer on the developer carrying member.

12. The developing apparatus as in claim 10 further comprising a developer regulating member for regulating quantity of developer on the developer carrying member, wherein the contact member is positioned at the upstream side of the developer regulating member with respect to the developer conveying direction.

13. The developing apparatus as in claim 10 further comprising a controller for controlling the direct voltage applied to the contact member to regulate an image density.

14. The developing apparatus as in claim 13 further comprising a density sensor for detecting an image density of a pattern image formed on the image carrying member, wherein the controller controls the direct voltage in response to a detected value of the density sensor.

15. The developing apparatus as in claim 10 further comprising a controller for controlling the ratio $t_1/t_2$ of the alternating voltage to regulate an image density.

16. The developing apparatus as in claim 15 further comprising a density sensor for detecting an image density of a pattern image formed on the image carrying member, wherein the controller controls the ratio $t_1/t_2$ of the alternating voltage in response to a detected value of the density sensor.

17. The developing apparatus as in claim 10 further comprising a controller for controlling the difference $V_1-V_2$ between the voltage $V_1$ and the voltage $V_2$ within a range of 300–1000V to regulate an image density.

18. The developing apparatus as in claim 15 further comprising a density sensor for detecting an image density of a pattern image formed on the image carrying member, wherein the controller controls the difference $V_1-V_2$ in response to a detected value of the density sensor.

19. A developing apparatus for developing an electrostatic latent image formed on an image carrying member with developer, the developing apparatus comprising:

a developer carrying member for carrying single-component developer and conveying it to a developing region;

a conductive contact member positioned to come into contact with the developer carrying member at an upstream side of the developing region with respect to the developer conveying direction; and a voltage applying member for applying the developer carrying member with a predetermined direct voltage as a developing voltage, applying the contact member with a voltage obtained by superimposing an alternating voltage on a direct voltage which has the same polarity as the developing voltage and has an absolute value larger than the developing voltage;

wherein a ratio $t_1/t_2$ of a time $t_1$ for applying a voltage $V_1$ of maximum absolute value to a time $t_2$ for applying a voltage $V_2$ of minimum absolute value satisfies a relation of $t_1/t_2>1$.

20. The developing apparatus as in claim 19, wherein the developer is a non-magnetic single-component developer.

21. The developing apparatus as in claim 19, wherein a difference $V_1-V_2$ between the voltage $V_1$ and the voltage $V_2$ is within a range of 300–1000V.

* * * * *